United States Patent [19]

Thioulouse

[11] Patent Number: 5,055,739

[45] Date of Patent: Oct. 8, 1991

[54] MEMORY-EQUIPPED MONOCHROME DISPLAY OF THE PHOTOCONDUCTOR-ELECTROLUMINESCENT TYPE

[75] Inventor: Pascal Thioulouse, Paris, France

[73] Assignee: L'Etat Francais represente par le Ministre des Postes, des Telecommunications et de l'Espace (Centre National d'Etudes des Telecommunications), Paris, France

[21] Appl. No.: 477,300

[22] Filed: Feb. 8, 1990

[30] Foreign Application Priority Data

Feb. 10, 1989 [FR] France ..... 89 01747

[51] Int. Cl.[5] ..... H01J 1/54

[52] U.S. Cl. ..... 313/507; 313/509; 313/112; 250/213 R

[58] Field of Search ..... 313/506, 507, 509, 505, 313/112; 250/208.2, 208.4, 213 R; 357/17, 19, 30 H, 30 L

[56] References Cited

U.S. PATENT DOCUMENTS

| | | | |
|---|---|---|---|
| 3,566,014 | 2/1971 | Norem | 313/507 |
| 3,648,052 | 3/1972 | Nakamura et al. | 250/213 R |
| 3,675,075 | 7/1972 | Kohashi | 313/506 |
| 3,699,374 | 10/1972 | Scholl et al. | 250/213 R |
| 3,852,798 | 12/1974 | Leabailly et al. | 357/17 |
| 4,808,880 | 2/1989 | Thioulouse | 313/507 |
| 4,877,995 | 10/1989 | Thioulouse et al. | 313/507 |

FOREIGN PATENT DOCUMENTS

| | | |
|---|---|---|
| 2335902 | 7/1977 | France . |
| 0259213 | 9/1988 | France . |

OTHER PUBLICATIONS

Electronics, vol. 43, No. 11, 05/25/70, pp. 112-117, New York, U.S.; L. Mirando et al.: "Flat-Screen Television Takes Two Giant Steps Forward", p. 116, colonne de gauche, paragraphe 2-paragraphe 4.

*Primary Examiner*—Donald J. Yusko
*Assistant Examiner*—John Giust
*Attorney, Agent, or Firm*—Hayes, Soloway, Hennessey & Hage

[57] ABSTRACT

A memory effect, monochromatic display of the photoconductor-electroluminescent type, includes on a substrate an electroluminescent layer and a photoconductor layer in stacked relation. The stack is interposed between two electrode systems used for exciting the electroluminescent layer, the latter having an emission spectrum overlapping the sensitivity spectrum of the photoconductor material. An optical filter is located between the electroluminescent layer and the display observer and permits the passage of that part of emission spectrum of the electroluminescent layer most useful for display purposes while blocking a region of the emission spectrum of the ambient illumination, the sensitivity spectrum of the photoconductor layer then being essentially contained in said region.

10 Claims, 4 Drawing Sheets

PRIOR ART

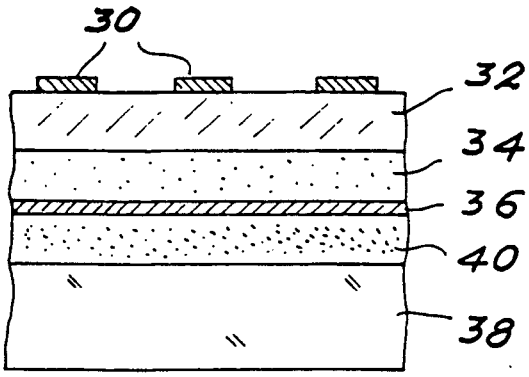
FIG. 5
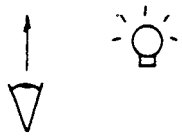
FIG. 6
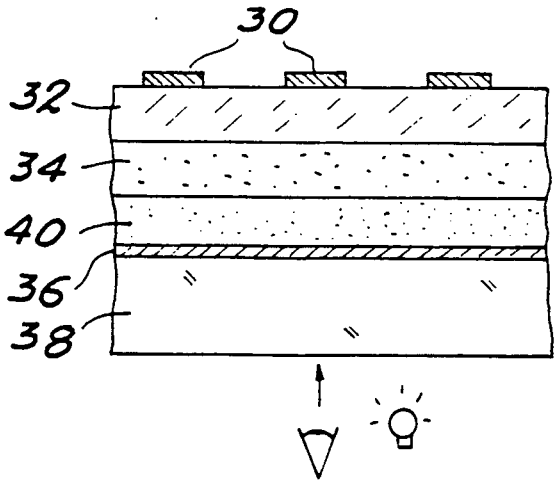
FIG. 7
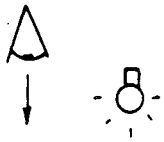
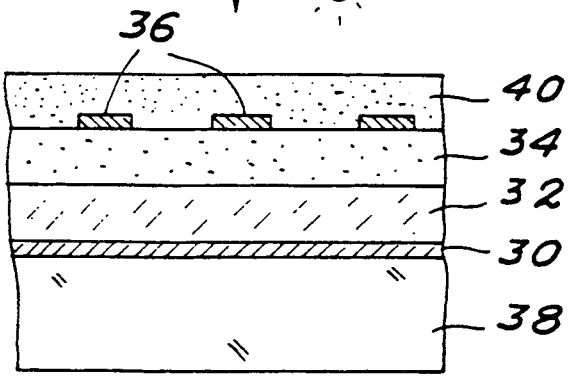
FIG. 8
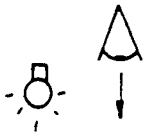
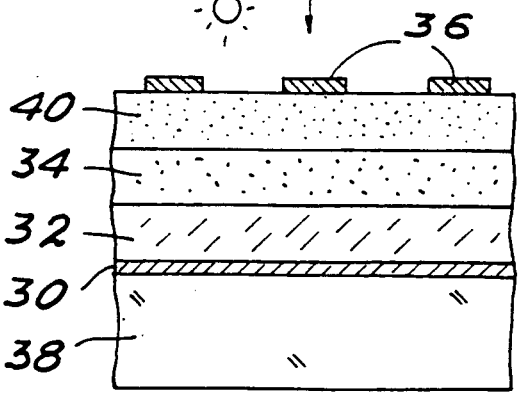

MEMORY-EQUIPPED MONOCHROME DISPLAY OF THE PHOTOCONDUCTOR-ELECTROLUMINESCENT TYPE

FIELD OF THE INVENTION

The present invention relates to an electroluminescent monochrome display having a memory effect usable in the optoelectronic field for the analog diplay of complex images or for the display of alphanumeric characters.

Brief details will firstly be given of the principle of a memory effect display of the photoconductor-electroluminescent type. A display is said to have the memory effect if its electrooptical characteristic (luminance-voltage curve) has a hysteresis. For the same voltage within the hysteresis loop, the display can consequently have two stable states, namely on or off. Alternating excitation, plasma screens have such a bistability characteristic and this is now widely used.

A' memory effect display offers significant advantages. For displaying a fixed image or picture, it is merely necessary to simultaneously and continuously apply to any screen a so-called maintenance voltage. The latter can be a sinusoidal signal or in the form of square waves, but in particular the shape and frequency of said maintenance signal can be chosen independently of the complexity of the screen and in particular the number of rows of display points. Thus, in principle there is no limit to the complexity of a memory effect display screen. Thus, alternating excitation, plasma screens are commercially available with 1200×1200 image points or pixels.

DESCRIPTION OF THE PRIOR ART

Moreover, the technology of display by thin film, capacitive coupling electroluminescence (ACTFEL) is now used in industry. Such means can be given a so-called inherent memory effect, but this leads to a significant deterioration in the electrooptical performance characteristics. A more attractive method consists of connecting a photoconductor structure (PC) in series with an electroluminescent structure (EL) and then optically coupling said two structures.

It is thus possible to produce an extrinsic memory effect, which is called the PC-EL memory effect and which is based on the following principle. When the means is in the off state, the photoconductor material is only slightly conductive and retains a significant part of the voltage V applied thereto. On increasing V to a value $V_{ON}$ such that the voltage at the terminals of the electroluminescent structure exceeds the electroluminescence threshold, the PC-EL means switches into the on state. The photoconductor material is then illuminated by the electroluminescent structure and passes into the conductive state. The voltage at its terminals drops and consequently there is an increase in the available voltage for the electroluminescent structure. For switching off a PC-EL means, it is merely necessary to reduce the total voltage V to a value $V_{OFF}$ lower than $V_{ON}$, which gives a luminance-voltage characteristic having a hysteresis.

Such a PC-EL structure was recently described in FR-A-2 574 972 and in the article by the inventor entitled "Monolithic Thin-Film Photoconductor-ACEL Structure with Extrinsic Memory by Optical Coupling" and published in IEEE Transactions on Electron Devices, vol. ED-33, No. 8, August 1986, pp 1149–1153.

This structure is diagrammatically shown in FIG. 1 and comprises a glass substrate 10 on which are deposited an electrode 12, a first dielectric layer 14, an electroluminescent layer 16, a second dielectric layer 18, a photoconductor layer 20, a third dielectric layer 21 and finally an electrode 22. The electrodes 12 and 22 are connected to an a.c. voltage source 24. In this construction, the PC and EL layers are in thin film form with a thickness of approximately 1 micrometer.

Such a structure can easily be produced, because it requires no supplementary etching stages. Moreover, the current-voltage behaviour of the thin film photoconductor in the dark is highly non-linear and reproducible. Thus, advantageously, the electrical illumination of the structure is always easy, the hysteresis is only slightly dependent on the exciting frequency and the reproducibility of the hysteresis margin between individual production runs is guaranteed.

However, the use of a PC-EL display under intense ambient illumination can unfortunately lead to a significant deterioration to the PC-EL hysteresis. Thus, illumination by an intense external source of the photoconductor layer can lead to a reduction to the voltage at the terminals of the latter and therefore to a drop in the illuminating voltage. Thus, this leads to an accidental illumination of certain normally extinguished pixels.

In addition, a PC-EL display is known, which has a photoconductor layer intercalated between a first and a second electroluminescent layers. The first electroluminescent layer has a light emission band between the limits of the excitation or sensitivity band of the photoconductor layer. The second electroluminescent layer has a light emission band outside said limits and which is in principle in the visible part of the light spectrum usable for display purposes. Such a display is described in FR-A-2 335 902.

This display has an even higher operating voltage V. In addition, this display and the preceding displays have a relatively mediocre contrast. Thus, the parasitic reflections of the electroluminescent emission of a specific memory point can disturb the display of the adjacent points.

SUMMARY OF THE INVENTION

The present invention specifically relates to an electroluminescent, memory effect, monochrome display making it possible to obviate the aforementioned disadvantages.

The display according to the invention comprises, on an insulating substrate, a single electroluminescent layer and a photoconductor layer in stacked form, the assembly formed by the two layers being intercalated between a first and a second electrode systems connected to a voltage source for exciting certain zones of the electroluminescent layer and is characterized in that the photoconductor layer is such that the overlap zone of the light sensitivity spectrum of the photoconductor layer and the emission spectrum of the ambient illumination is at a minimum and in that the electroluminescent layer is such that the overlap zone of the sensitivity spectrum and the emission spectrum of the electroluminescent layer is at a maximum.

The overlap of the emission spectrum of the electroluminescent layer and the sensitivity spectrum of the photoconductor layer ensures the bistability of the PC-EL display.

When the emission spectrum of the ambient illumination is known, which is the case during the use of the display internally with a given illumination type having a reduced emission range (e.g. use of monochromatic lamps in certain laboratories), the photoconductor layer must have a sensitivity spectrum outside the emission specturm of the ambient illumination. This requires the use of photoconductor materials having sensitivity spectra located in shorter or longer wavelengths than those contained in the emission spectrum of the ambient illumination.

For example, in the case of fluorescent lamps, corresponding to the visible range between 450 and 700 nm, use is made either of a photoconductor layer, whose cut-off wavelength on the side of the higher wavelengths, designated $\lambda_2$ and determined at mid-height on the sensitivity spectrum of the photoconductor material, is located in the ultraviolet, i.e. below 450 nm, or a photoconductor layer, whose cut-off wavelength on the side of the shorter wavelengths, designated $\lambda_1$ and determined at mid-height on the sensitivity spectrum of the photoconductor layer, is located in the infrared, i.e. above 700 nm.

In order to ensure the bistability of the PC-EL display, the emission spectrum of the electroluminescent layer must cover both the visible spectrum with a view to the display and the sensitivity spectrum of the photoconductor material.

The electroluminescent material can have a broad band emission spectrum or an emission spectrum with several bands, one of these bands being in the visible spectrum and the other in the ultraviolet or infrared, as a function of the photoconductor material used.

As an example of a photoconductor material having its light sensitivity peak in the infrared, reference can be made to CdSe. An example of an electroluminescent material with an emission in the visible and in the infrared ranges, reference can be made to $ZnS:Tm^{3+}$ or $ZnS:Mn^{2+}$ with a high $Mn^{2+}$ content (above 1 atomic %).

An example of a photoconductor material having a sensitivity spectrum in the ultraviolet, reference can be made to hydrogenated, carbonated amorphous silicon of formula $a\text{-}Si_{1-x}C_x:H$ with x close to 0.4, which corresponds to a methane concentration C in the methane-silane gaseous mixture used for the deposition of a layer of such material equal to 0.99. In other words $C=[CH_4]/[CH_4]+[SiH_4]$. The material has a high cut-off wavelength $\lambda_2$ of 450 nm and a maximum sensitivity at $\lambda_{04}=425$ nm.

When the emission spectrum of the ambient illumination is not well known, which is the most frequent case (external illumination possibly associated with internal illumination), use is made of an optical filter between the electroluminescent layer and the observer of the display and its function is to permit the passage of that part of the emission spectrum of the electroluminescent layer most useful for display purposes, whilst blocking or blanking a region of the emission spectrum of the ambient illumination, the sensitivity spectrum of the photoconductor layer then being essentially contained in said region.

The most useful part for the display of the emission spectrum of the electroluminescent layer is that retaining a sufficiently high luminescence, as well as an emission colour compatible with the envisaged use.

The fact that the sensitivity spectrum of the photoconductor layer is integrally or quasi-integrally contained in the region of the emission spectrum blocked by the optical filter makes it possible to avoid the influence of the ambient light on the photoconductor layer and therefore the inopportune illumination of undisplayed points.

The electroluminescent layer can then have a relatively broad emission spectrum, so as to cover not only part of the unblocked visible spectrum for the display, but also a significant part of the sensitivity spectrum of the photoconductor layer in the blocked part for the PC-EL effect.

The optical filter can be a band pass filter, a low pass filter or a high pass filter. The electroluminescent material can have a broad band spectrum or a spectrum formed by several bands (at least two bands), one of the bands being in the transmission spectrum of the filter and the other in the spectral blocking range of the filter.

An example of a broad band material with a given spectrum is $ZnS:Mn^{2+}$ with a relatively narrow emission band in the yellow and orange; $CaS:Eu^{2+}$ with a red colour cast; $SrS:Eu^{2+}$ with a colour cast between red and orange; $CaS:Ce^{3+}$ with a colour cast between green and orange; and $SrS:Ce^{3+}$ with a colour cast between blue and green.

An example of a broad band electroluminescent material for which the emission spectrum can be modified as a function of the optical filter and the photoconductor material used is $Ca_xSr_{1-x}S:Eu^{2+}$ with x between 0 and 1, the colour cast for $x=1$ being red and for $x=0$ orange; $Ca_xSr_{1-x}S:Ce^{3+}$ with x between 1 and 0, $x=1$ corresponding to a green colour cast and $x=0$ to a blue colour cast. It is also possible to mix two luminescent activators in the same matrix for adapting the broad emission band of the electroluminescent material. The spectrum obtained is then a combination of the elementary spectra of the two activators, reference being made in exemplified manner to $SrS:Eu^{2+},Ce^{3+}$; $CaS:Eu^{2+},Ce^{3+}$; $SrS:Ce^{3+},Pr^{3+}$.

Examples of electroluminescent materials with several narrow bands or lines usable in the invention are $ZnS:Sm^{3+}$ with a red colour cast; $ZnS:Tb^{3+}$ with a green colour cast and a green-blue colour cast; $ZnS:Tm^{3+}$ with a blue colour cast and near infrared (780 nm); $SrS:Pr^{3+}$ with two colour casts, one in the red and the other in the blue-green. It is also possible to use alloys such as $Zn_xSr_{1-x}S:Tb^{3+}$; $Zn_xCa_{1-x}S:Tb^{3+}$; $Sr_xCa_{1-x}S:Tb^{3+}$ with x between 0 and 1.

It is possible to modify the emission spectrum with lines of certain electroluminescent materials by using several activators in the same matrix, such as $ZnS:Sm^{3+}, Tb^{3+}$.

More detailed information on the form of the spectra of the electroluminescent materials given hereinbefore reference can be made to the article by Shosaku Tanaka et al, SID-88 Digest, pp 293–296 "Bright-white-light electroluminescent devices with new phosphor thin-films based on SrS"; to the article by Hiroshi Kobayashi "Recent Development of Multi-color Thin-Film Electroluminescence Research"; abstract No. 1231, pp 1712/3, "Extended Abstracts of Electrochemical Society Meeting", vol. 87-2, 18–23 October 1987; and to the article by Shosaku Tanaka "Color electroluminescence in alkaline-earth sulfide thin-films", Journal of Luminescence, 40 and 41, 1988, pp 20–23.

Examples of photoconductor materials usable in the invention and having a sensitivity spectrum adjustable as a function of the electroluminescent material used reference can be made to $CdS_xSe_{1-x}$ or $a\text{-}Si_{1-x}C_x:H$ with x between 0 and 1. It is also possible to use photoconductor materials with a given sensitivity spectrum, such as CdS, CdSe or a-Si:H.

For more detailed information on production and on the properties of hydrogenated and carbonated amorphous silicon, reference can be made to FR-A-2 105 777 filed in the name of the inventor.

For more detailed information on the sensitivity spectra of the materials $CdS_xSe_{1-x}$, reference can be made to the article by Robert et al, Journal of Applied Physics, vol. 48, No. 7, July 1977, pp 3162-3164 "II-VI solid-solution films by spray pyrolysis". Preference is given to the use of a-$Si_{1-x}C_x$:H with $0 \leqq x \leqq 0.5$.

The optical filters can be interference filters. These filters make it possible to obtain low pass, high pass and band pass spectra with random cut-off wavelengths. In addition, they have a sudden spectral transition from the conductive state to the non-conductive state, as well as a high chemical and thermal stability. However, these filters are often expensive. Furthermore, when possible, preference is given to the use of coloured glass or organic filters.

Organic filters are more particularly those used for liquid crystal polychromatic screens, such as layers of polymer or gelatin containing colouring agents or organic pigments; polyimide layers with colouring agents; vacuum evaporated organic colouring agents or pigments; perylene (red), lead phthalocyanine (blue), copper phthalocyanine (green), quinacridone (magenta), isoindolinone (yellow); as well as electrodeposited pigments.

According to the invention, all known electrode systems for display purposes can be used. In particular one of the electrode systems can be constituted by point electrodes and the other system by a common electrode. Advantageously, the electrode systems are in each case constituted by parallel conductive strips, the conductive strips of the first system crossing the conductive strips of the second.

Moreover, the display according to the invention can operate in reflection or transmission. As a function of the operating type used, one or both electrode systems can be transparent.

BRIEF DESCRIPTION OF THE DRAWINGS

Other features and advantages of the invention can be gathered from the following non-limitative, illustrative description with reference to the attached figures.

FIGS. 5 to 8 give variants of the display according to the invention.

DESCRIPTION OF THE PREFERRED EMBODIMENTS

Figure 1:
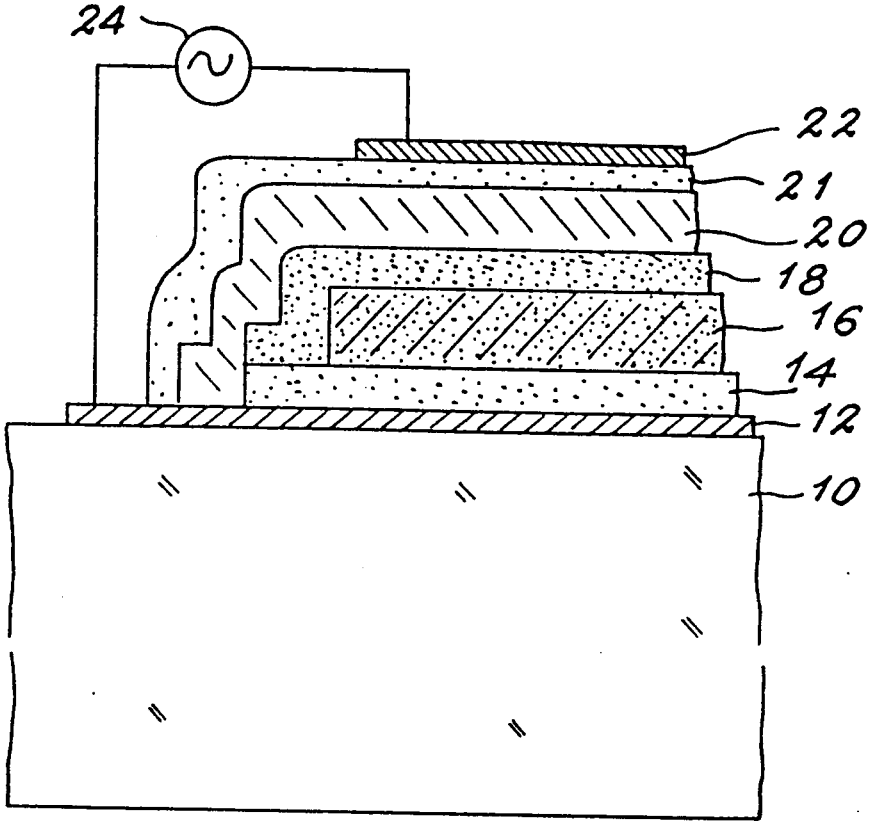
FIG. 1 illustrates a prior art PC-EL structure with a glass substrate.
Figure 2:
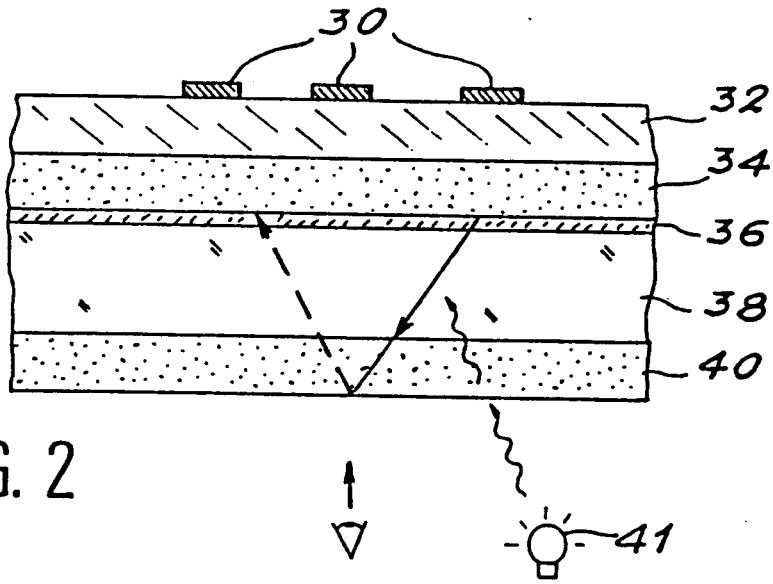
FIG. 2 diagrammatically shows an embodiment of a display according to the invention.

In FIG. 2, the display according to the invention has a first electrode system constituted by parallel conductive strips 30, which are generally reflecting and made from aluminium. These electrodes 30 are located on a a-$Si_{1-x}C_x$:H photoconductor layer 32 with $0 \leqq x \leqq 1$, which has a thickness of 1 micrometer and which covers an electroluminescent structure constituted by a single emitting layer 34, as shown in FIG. 2, or associated with one or more dielectric layers, as shown in FIG. 1 or Fr-A-2 574 972.

The electroluminescent material is in particular one of those referred to hereinbefore. Its thickness is between 0.5 and 2 micrometers (typically 0.7 micrometer). The dielectric layers 14, 18 and 21 can be produced from one of the materials chosen from among $Si_3N_4$, $SiO_2$, $SiO_xN_y$ and $Ta_2O_5$ and can have a thickness of 200 nm.

With a view to a simplification of the drawings and description, the remainder of the text only relates to a single electroluminescent layer 34. Below the latter is provided the second electrode system 36 constituted by parallel conductive strips made from e.g. transparent ITO, the electrodes 36 being located perpendicular to electrodes 30.

The second electrode system 36 is supported by a generally glass, insulating substrate 38, which is provided with a filter 40 on its lower face. The observation of the display takes place on the rear face of the display means, i.e. from the side of the filter. In the same way, the illumination of the display means takes place from the side of the filter with the aid of a white lamp 41. The filter 40 of the display according to the invention permits an effective filtering of the parasitic reflections of a pixel due to the electroluminescent emission and therefore prevents any disturbance or interference with adjacent pixels.

The display according to the invention functions in the same way as the prior art displays and in particular uses an alternating power supply 24 connected to electrodes 36 and 30, the oscillating frequency being 1 kHz and the peak amplitude 150 to 290 V (typically 230 V). Using the IBM display, the operating voltage is typically 300 V, i.e. above that used in the invention.

Figure 3A:
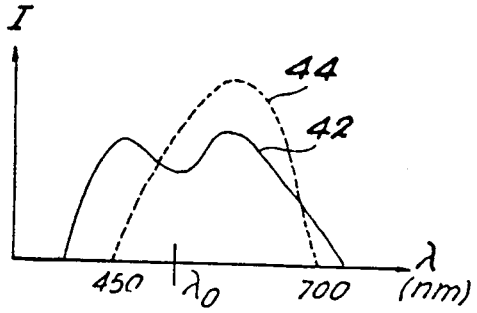
FIGS. 3*a*–3*e* and 4*a*–4*e* give the configuration of the sensitivity and emission spectra of the photoconductor and electroluminescent layers, as well as the transmission spectrum of the filter of the display of FIG. 2.
Figure 4A:
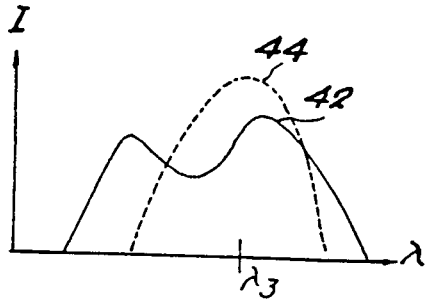
Figure 3B:
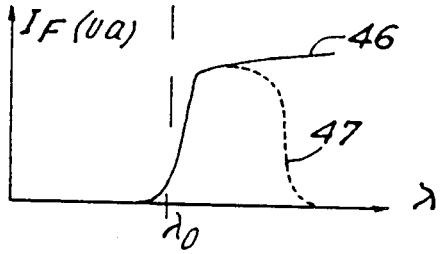
Figure 3C:
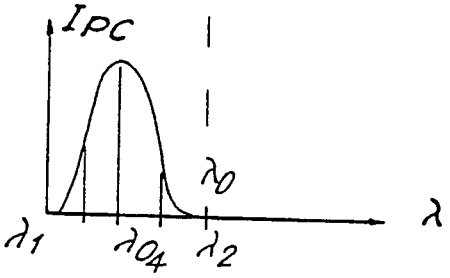
Figure 4C:
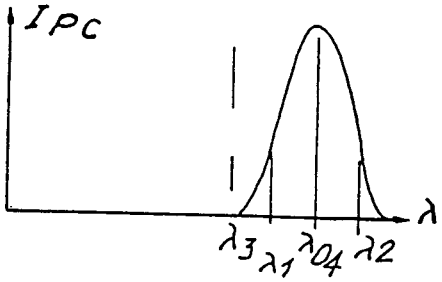
Figure 3D:
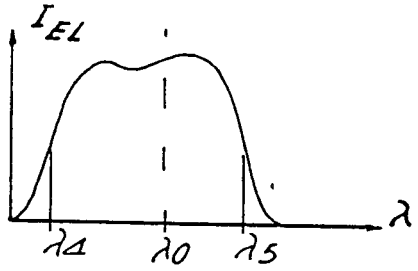
Figure 4D:
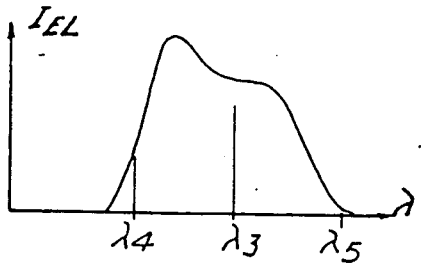
Figure 3E:
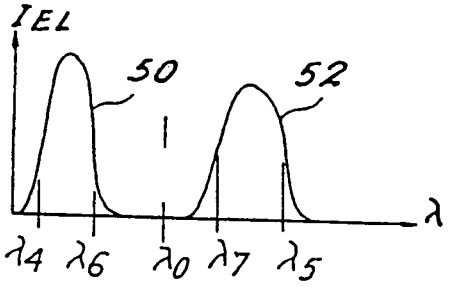

FIG. 3*a* shows the emission spectrum 42 of the ambient light and the visible spectrum 44. FIG. 3*b* shows the transmission spectrum of an optical filter F. Curve 46 corresponds to the transmission spectrum of a high pass filter and curve 47 to that of a band pass transmission filter. FIG. 3*e* shows the sensitivity spectrum of the photoconductor material (PC). FIG. 3*d* shows the emission spectrum of a broad band electroluminescent material (EL), whilst FIG. 3*e* shows the luminescence spectrum of an electroluminescent material having several lines. These spectra give the variations of the light intensity I as a function of the wavelength, the light intensity being given in arbitrary units and with a wavelength in nanometers.

According to the invention, the high pass or band pass filter (FIG. 3*b*) has a cut-off wavelength $\lambda_0$ below which the ambient light is filtered and above which the ambient light is transmitted. This cut-off wavelength $\lambda_0$ is such that the transmission spectrum of the filter is essentially in the visible light spectrum 44 with a view to the display. In practice, $\lambda_0$ corresponds to the energy of the transmitted light.

The photoconductor material (FIG. 3*c*) has a lower cut-off wavelength $\lambda_1$ and a higher cut-off wavelength $\lambda_2$, said wavelengths being taken for a mid-height sensitivity of the sensitivity spectrum and $\lambda_{04}$ corresponds to the maximum sensitivity wavelength of the photoconductor material.

According to the invention, the sensitivity spectrum of the photoconductor is outside the transmission spectrum of the filter, which means that $\lambda_2$ is below $\lambda_0$. Thus, the photoconductor material is no longer disturbed by the ambient light. In practice, $\lambda_2$ is equal to or lower than $\lambda_0$.

In order to ensure the bistability of the EL-PC means, the emission spectrum of the electroluminescent material must have part of its spectrum in the sensitivity spectrum of the photoconductor material and another part in the visible range.

In the case of a broad band material (FIG. 3*d*), the lower cut-off wavelength $\lambda_4$, determined at mid-height on the emission spectrum, must be close to $\lambda_1$ and the upper cut-off wavelength $\lambda_5$ of the electroluminescent material, determined at mid-height on the emission spectrum, must be higher than $\lambda_0$.

For an electroluminescent material with lines (FIG. 3*e*), the upper cut-off wavelength $\lambda_6$ of the lowest wavelength line 50, taken at mid-height on curve 50, is preferably chosen below $\lambda_0$, with $\lambda_4 < \lambda_6$ when the lower cut-off wavelength $\lambda_7$ of the highest wavelength line 52, determined at mid-height from curve 52, is preferably chosen higher than $\lambda_0$, $\lambda_5$ then exceeding $\lambda_7$.

FIG. 4 shows different light intensity spectra required for the filter, the photoconductor material and the electroluminescent material, when using a low pass or band pass filter having an upper cut-off wavelength $\lambda_3$.

The light intensities of the spectra of FIG. 4 are given in arbitrary units as a function of a wavelength in nanometers. FIG. 4*a* gives the emission spectrum of the ambient light. FIG. 4*b* gives the light transmission spectrum of the filter. FIG. 4*c* gives the sensitivity spectrum of the photoconductor material. FIGS. 4*d* and 4*e* respectively give the emission spectrum of a broad band electroluminescent material and one having lines. Curve 48 of FIG. 4*b* corresponds to a low pass filter and curve 49 to a band pass filter.

In this case, it is the ambient light in the wavelengths higher than $\lambda_3$ which is blocked by the filter and the light of wavelengths below $\lambda_3$ which is transmitted by the filter. The photoconductor material (FIG. 4*c*) must then have a sensitivity spectrum above $\lambda_3$ and in particular $\lambda_1$ is equal to or above $\lambda_3$.

As hereinbefore, the emission spectrum of a broad band electroluminescent material (FIG. 4*d*) must have a lower cut-off wavelength $\lambda_4$, below $\lambda_3$ and a higher cut-off wavelength $\lambda_5$, higher than $\lambda_3$. In the case of an electroluminescent material with lines (FIG. 4*c*), $\lambda_6$ corresponding to a high cut-off wavelength for the first emission band 54 is also preferably below $\lambda_3$ and $\lambda_7$ corresponding to the low cut-off wavelength of the upper emission band 56 of the electroluminescent material is preferably in excess of $\lambda_3$.

The different layers or films constituting the display according to the invention can be arranged in different ways, as can be gathered from FIGS. 5 to 8. The only requirement is that the filter 40 is positioned between the observer and the electroluminescent layer 34.

Moreover, as shown in FIG. 5, it is possible to reverse the position of the glass substrate 38 with that of the filter 40 compared with FIG. 2 or, as shown in FIG. 6, to arrange the optical filter 40 between the second series of electrodes 36 and the electroluminescent structure 34.

As shown in FIG. 7, it is also possible to reverse the positions of the two electrode systems. In this case, observation takes place via the front face of the display. In this embodiment, from top to bottom are provided the optical filter 40, the transparent electrodes 36, the electroluminescent structure 34, the photoconductor layer 32, the reflecting electrodes 30 and finally the glass substrate 38.

For an observation by the front face, it is also possible in the manner shown in FIG. 8 to reverse the positions of optical filter 40 and electrodes 36.

Exemplified embodiments of the display according to the invention are given hereinafter. In these examples, the electroluminescent material is a-$Si_{1-x}C_x$:H, with $0 \leqq x \leqq 1$. This material is deposited by plasma assisted chemical vapour phase deposition (PECVD) with a low power level of approximately 0.1 W/cm$^2$. For further details on the method of depositing a-$Si_{1-x}C_x$:H, reference can be made to the article by M. P. Schmidt et al, Philosophical Magazine B, 1985, vol. 51, No. 6, pp 581–589 "Influence of carbon incorporation in amorphous hydrogenated silicon".

This photoconductor material has a certain number of advantages. In particular, it has a sensitivity drop on the side of the high wavelengths (i.e. on the low energy side) corresponding to a drop in the optical absorption or optical forbidden band. It is pointed out that $\lambda(\text{nm}) = 1240/E(\text{eV})$.

A feature of the photoconductivity spectrum of this material is the energy $E_{04}$ (in eV) for which the absorption coefficient $\alpha$ is $10^4$ cm$^{-1}$. This energy $E_{04}$ can be adjusted by acting on the carbon content C, i.e. on the methane content in the methane-silane mixture used for the production of said photoconductor material.

On the side of the short wavelengths (high energy levels), the sensitivity of the photoconductor material also drops, because the radiation is absorbed in all the first layers of the photoconductor layer and the photoconduction, investigated in the direction normal to the plane of the layers (transverse electrical excitation) is prevented, because the core of the photoconductor layer is not exposed to the excitation radiation.

The resultant photosensitivity spectrum for a 1 micrometre thick layer is a wide peak, whose mid-height width is approximately 50 namometres and whose maximum is at $E_{04}$. The mid-height width corresponds to the distance separating the high and low cut-off thresholds, i.e. separating $\lambda_1$ from $\lambda_2$ in FIGS. 3*c* or 4*c*.

EXAMPLES

EXAMPLES 1 TO 3

These examples relate to FIG. 3, which corresponds to the use of a high pass or band pass filter. Moreover, they relate to broad band electroluminescent materials FIG. 3*d*.

1) Electroluminescent material: $ZnS:Mn^{2+}$ with emission from yellow to orange.

ORIEL interference filter with a cut-off wavelength $\lambda_0$ of 585 nm.

Photoconductor material with a wavelength $\lambda_2$ equal to 585 nm and $\lambda_{04}$ close to 560 nm, which corresponds to $E_{04}$ close to 2.2 eV and consequently to a methane concentration C of approximately 0.6 and to x equal to 0.10.

The resultant emission of the screen is orange.

2) Electroluminescent material: $SrS:Eu^{2+}$, emission from red to orange.

ORIEL interference filter with a cut-off wavelength $\lambda_0$ equal to 600 nm.

Photoconductor material with $\lambda_2 = 600$ nm and $\lambda_{04}$ equal to 575 nm corresponding to $E_{04}$ of 2.15 eV and with C close to 0.50 and x equal to 0.07. The resultant emission of the screen is red.

3) Electroluminescent material: $CaS:Eu^{2+}$ with emission in the red.

ORIEL interference filter with $\lambda_0$ 630 nm.

Photoconductor material with $\lambda_2$ of 630 nm, $\lambda_{04}$ of 600 nm, $E_{04}=2.07$ eV and C close to 0.40 and x=0.04.

The resultant emission is in the dark red.

EXAMPLES 4 TO 6

These examples relate to high pass filters (FIG. 3*b*) associated with electroluminescent materials with lines (FIG. 3*e*).

4) Electroluminescent material: $ZnS:Tb^{3+}$ with a line in the green and a line in the green-blue.

ORIEL interference filter with $\lambda_0$ 530 nm.

Photoconductor material: $\lambda_2$ 530 nm, $\lambda_{04}$ 500 nm, $E_{04}=2.48$ eV, C 0.8 and x=0.20.

The resultant emission is green.

5) Electroluminescent material: $ZnS:Sm^{3+}$ (emission from yellow to red).

ORIEL interference filter with $\lambda_0$ equal to 640 nm.

Photoconductor material: $\lambda_2$ 640 nm, $\lambda_{04}$ 615 nm, $E_{04}=2.02$ eV, C close to 0.30 and x=0.03.

The resultant emission is red.

6) Electroluminescent material: $SrS:Pr^{3+}$ with one line in the green-blue and one line in the red.

ORIEL interference filter: $\lambda_0=600$ nm.

Photoconductor material: $\lambda_2$ 600 nm, $\lambda_{04}=575$ nm, $E_{04}=2.15$ eV, C close to 0.50 and x=0.07.

The resultant emission is in the red.

EXAMPLES 7 TO 9

Figure 4B:
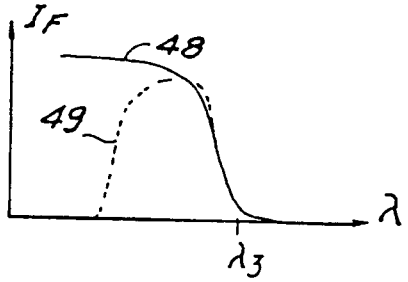

These examples relate to the use of a low pass or band pass filter, whose transmission spectrum is given in FIG. 4*b*. In addition, the electroluminescent material is a broad band material, whose spectrum is similar to that of FIG. 4*d*.

7) Electroluminescent material: $ZnS:Mn^{2+}$ with emission from yellow to orange.

ORIEL interference filter with a low cut-off wavelength $\lambda_3$ of 585 nm.

Photoconductor material: $\lambda_1$ 585 nm, $\lambda_{04}$ 610 nm, $E_{04}=2.03$ eV, C close to 0.30 and x=0.03.

The resultant emission is yellow.

8) Electroluminescent material: $SrS:Ce^{3+}$ with emission from green to blue.

ORIEL interference filter with $\lambda_3$ close to 500 nm.

Photoconductor material: $\lambda_1$ 500 nm, $\lambda_{04}$ close to 525 nm, $E_{04}=2.36$ eV, C close to 0.70 and x=0.14.

The resultant emission is blue.

9) Electroluminescent material: $CaS:Ce^{3+}$ with emission from green to orange.

ORIEL interference filter with $\lambda_3$ close to 540 nm.

Photoconductor material: $\lambda_1$ of approximately 540 nm, $\lambda_{04}$ close to 565 nm, $E_{04}=2.20$ eV, C=0.60 and x=0.10.

The resultant emission is in the blue-green.

EXAMPLES 10 AND 11

Figure 4E:
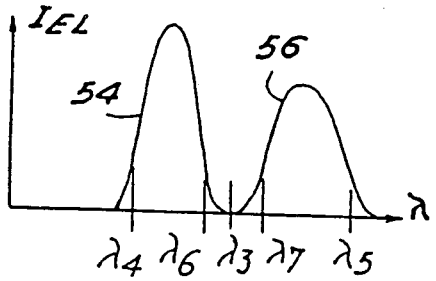

These examples relate to a low pass interference filter (FIG. 4*b*) associated with electroluminescent materials having a spectrum with lines (FIG. 4*e*).

10) Electroluminescent material: $ZnS:Tb^{3+}$ (one line in the green and one line in the blue-green).

ORIEL interference filter with $\lambda_3$ equals 570 nm. Photoconductor material: $\lambda_1$ 570 nm, $\lambda_{04}$ close to 595 nm, $E_{04}=2.08$ eV, C=0.40 and x=0.04.

The resultant emission is in the green.

11) This example is identical to example 10 with the exception of the electroluminescent material, which is $SrS:Pr^{3+}$ with one line in the blue-green and one line in the red. The resultant emission is in the blue-green.

In the above examples 1 to 11, the arrangement of the different layers of the display can be any of those shown in FIGS. 2 and 5 to 8.

In the embodiments shown in FIGS. 5 and 6, the conventionally used polymer or gelatin-based optical filters must be avoided in view of the fact that the filter is deposited before the electroluminescent and photoconductor materials during the production of the display and therefore they undergo constraining thermal cycles of 150° to 200° C. Such filters are only able to withstand temperatures of <100° C.

I claim:

1. Electroluminescent monochrome display with a memory effect comprising on an insulating substrate an assembly having a single electroluminescent layer (16, 34) in contact with a photoconductor layer (20, 32) or separated from said photoconductor layer by a first transparent dielectric layer (18), said assembly of said two layers being inserted between a first (36) and a second (30) systems of electrodes connected to a power supply (24) for exciting certain zones of the electroluminescent layer, said photoconductor layer (32) being such that the overlap zone of the light sensitivity spectrum of said photoconductor layer and the emission spectrum of the ambient illumination is at a minimum and said electroluminescent layer (34) being such that the overlap zone of said sensitivity spectrum and the emission spectrum of the electroluminescent layer is at a maximum, the emission spectrum of the electroluminescent layer overlapping also the visible spectrums and an optical filter (40) located between the electroluminescent layer (34) and the display observer and permitting the passage of that part of the emission spectrum of the electroluminescent layer most useful for display purposes, while blocking a region of the emission spectrum of the ambient illumination, the sensitivity spectrum of the photoconductor layer (32) being essentially contained in said region.

2. Display according to claim 1, characterized in that the electroluminescent layer (34) is constituted by a broad band or multiband emission spectrum.

3. Display according to claim 1, characterized in that the optical filter (40) is a high pass, low pass or band pass filter.

4. Display according to claim 1, characterized in that the electroluminescent layer (16) is placed between said first (18) and a second dielectric layers.

5. Display according to claim 1, characterized in that a dielectric layer (21) is placed between photoconductor layer (20) and one of the two electrode systems (30, 36).

6. Display according to claim 1, characterized in that the photoconductor layer (32) is of hydrogenated and carbonated amorphous silicon of formula $a\text{-}Si_{1-x}C_x:H$ with $0 \leqq x \leqq 1$.

7. Display according to claim 1, characterized in that the electrode systems (30, 36) are in each case constituted by parallel conductive strips, the conductive strips of the first system (36) crossing the conductive strips of the second system (30).

8. Display according to claim 1, characterized in that the first electrode system (36) is transparent and in contact with the substrate (38) which also is transparent, and in that the second electrode system (30) is reflecting.

9. Display according to claim 1, characterized in that the photoconductor layer is of hydrogenated and carbonated amorphous silicon of formula a-$Si_{1-x}C_x$:H with $0 \leqq x \leqq 0.5$.

10. Display according to claim 1, characterized in that photoconductor layer is of hydrogenated and carbonated amorphous silicon of formula a-$Si_{1-x}C_x$:H with $0 < x < 0.5$.

* * * * *